US011053952B2

(12) United States Patent
Nakaniwa et al.

(10) Patent No.: US 11,053,952 B2
(45) Date of Patent: Jul. 6, 2021

(54) IMPELLER AND ROTARY MACHINE

(71) Applicant: MITSUBISHI HEAVY INDUSTRIES COMPRESSOR CORPORATION, Tokyo (JP)

(72) Inventors: Akihiro Nakaniwa, Tokyo (JP); Akinori Tasaki, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 69 days.

(21) Appl. No.: 16/488,351

(22) PCT Filed: Feb. 22, 2018

(86) PCT No.: PCT/JP2018/006413
§ 371 (c)(1),
(2) Date: Aug. 23, 2019

(87) PCT Pub. No.: WO2018/159439
PCT Pub. Date: Sep. 7, 2018

(65) Prior Publication Data

US 2020/0232474 A1 Jul. 23, 2020

(30) Foreign Application Priority Data

Feb. 28, 2017 (JP) ..... JP2017-036700

(51) Int. Cl.
*F04D 29/30* (2006.01)
*F04D 17/12* (2006.01)
*F04D 29/28* (2006.01)

(52) U.S. Cl.
CPC ..... *F04D 29/30* (2013.01); *F04D 17/122* (2013.01); *F04D 29/281* (2013.01)

(58) Field of Classification Search
CPC ..... F04D 29/2222; F04D 29/2216; F04D 29/242; F04D 29/30
See application file for complete search history.

(56) References Cited

U.S. PATENT DOCUMENTS 1,383,354 A * 7/1921 Wareing ..... F04D 29/2255 416/183
2,576,700 A * 11/1951 Schneider ..... F01D 5/141 416/183

(Continued)

FOREIGN PATENT DOCUMENTS

CN 205383109 U 7/2016
FR 892480 A 4/1944

(Continued)

OTHER PUBLICATIONS

European Search Report in corresponding European Application No. 18761771.7, dated Jan. 24, 2020 (8 pages).

(Continued)

*Primary Examiner* — Ninh H. Nguyen
(74) *Attorney, Agent, or Firm* — Osha Bergman Watanabe & Burton LLP

(57) ABSTRACT

An impeller includes: a disk that has a disk shape and is configured to rotate around an axis; and a plurality of blades that are provided at intervals in a circumferential direction on a side of a surface of the disk toward a direction of the axis and extend to a rear side in a rotation direction as the plurality of the blades go toward an outer side in a radial direction. Each of the plurality of the blades has: a primary blade which extends to the rear side in the rotation direction as the primary blade goes from an inner side toward the outer side in the radial direction, and a secondary blade which is provided at intervals on a side in front of the primary blade in the rotation direction to correspond to the primary blade.

11 Claims, 6 Drawing Sheets

(56) References Cited

U.S. PATENT DOCUMENTS

| | | | | |
|---|---|---|---|---|
| 2,753,808 | A * | 7/1956 | Kluge | F01D 5/145 416/183 |
| 3,221,662 | A * | 12/1965 | White | F04D 29/281 415/198.1 |
| 4,502,837 | A | 3/1985 | Blair et al. | |
| 4,615,659 | A | 10/1986 | Sidransky | |
| 6,893,207 | B2 * | 5/2005 | Kao | F04D 29/2288 415/58.2 |
| 2008/0050228 | A1 * | 2/2008 | Chen | F04D 29/30 415/204 |

FOREIGN PATENT DOCUMENTS

| | | | |
|---|---|---|---|
| GB | 180299 | A | 10/1922 |
| JP | S29-004727 | B | 7/1954 |
| JP | S52-144803 | A | 12/1977 |
| JP | S54-057603 | U | 4/1979 |
| JP | S58-079094 | U | 5/1983 |
| JP | S59-090797 | A | 5/1984 |
| JP | S59-190498 | A | 10/1984 |
| JP | S62-291498 | A | 12/1987 |
| JP | H02-012096 | U | 1/1990 |
| JP | H02-140493 | A | 5/1990 |
| JP | H09-310697 | A | 12/1997 |
| JP | 2002-349487 | A | 12/2002 |

OTHER PUBLICATIONS

International Search Report issued in corresponding International Application No. PCT/JP2018/006413, dated May 29, 2018 (4 pages).

Written Opinion issued in corresponding International Application No. PCT/JP2018/006413, dated May 29, 2018 (13 pages).

* cited by examiner

IMPELLER AND ROTARY MACHINE

TECHNICAL FIELD

The present invention relates to an impeller and a rotary machine.

Priority is claimed on Japanese Patent Application No. 2017-036700, filed Feb. 28, 2017, the content of which is incorporated herein by reference.

BACKGROUND ART

As rotary machines used in industrial compressors, turbo refrigerators, small-sized gas turbines, pumps, and the like, rotary machines including an impeller in which a plurality of blades are attached to a disk that is fixed to a rotary shaft are known. The foregoing rotary machines apply pressure energy and speed energy to a gas by rotating the impeller (for example, refer to Patent Literature 1).

CITATION LIST

Patent Literature

[Patent Literature 1]

Japanese Unexamined Patent Application, First Publication No. H9-310697

SUMMARY OF INVENTION

Technical Problem

Incidentally, in recent years, there has been demand for realizing an impeller which can obtain greater lift.

The present invention provides an impeller which can obtain greater lift, and a rotary machine including the impeller.

Solution to Problem

According to a first aspect of the present invention, an impeller includes a disk that has a disk shape and is configured to rotate around an axis, and a plurality of blades that are provided at intervals in a circumferential direction on a side of a surface of the disk directed in a direction of the axis and extend to a rear side in a rotation direction as the plurality of the blades go toward an outer side in a radial direction. Each of the plurality of the blades has a primary blade which extends to the rear side in the rotation direction as the primary blade goes from an inner side toward the outer side in the radial direction and of which a rear edge is positioned on the inner side with respect to an outer circumferential edge portion of the disk in the radial direction; and a secondary blade which is provided at intervals on a side in front of the primary blade in the rotation direction to correspond to the primary blade, of which a front edge is positioned on the outer side of a front edge of the primary blade in the radial direction, and of which a rear edge is positioned on the outer circumferential edge portion of the disk.

In such an impeller, a border layer which grows as it goes toward the downstream side on a pressure surface (surface toward the front side in the rotation direction) of the primary blade is cut off between the rear edge of the primary blade and the front edge of the secondary blade. A flow including the cut border layer is transferred to an outer circumferential edge of the disk by the pressure surface of the secondary blade. Accordingly, greater lift can be obtained.

That is, the border layer is temporarily reset between the primary blade and the secondary blade. Therefore, lift can be effectively obtained thereafter by the secondary blade, and greater lift can be realized in the impeller overall.

In the foregoing impeller, a rear edge side region on a pressure surface of the primary blade and a front edge side region on a suction surface of the secondary blade corresponding to the primary blade may face each other.

In this case, the rear edge side region on the pressure surface of the primary blade and the front edge side region on the suction surface of the secondary blade overlap each other in a direction orthogonal to a flow of a fluid. Therefore, the border layer which has grown on the pressure surface of the primary blade is cut off by the front edge on the suction surface and is transferred as it stands to the outer side in the radial direction along the pressure surface of the primary blade. Therefore, the border layer can be more reliably cut off by a flow between the primary blades. On the other hand, since the primary blade does not lead to the outer circumferential edge portion of the disk, the primary blade does not cause peeling.

In the foregoing impeller, it is preferable that the secondary blade be disposed close to the corresponding primary blade of a pair of primary blades adjacent to each other.

Accordingly, the border layer which has grown on the pressure surface of the primary blade to which the secondary blade corresponds can be more reliably cut off by the secondary blade.

In the foregoing impeller, the secondary blade may have a plurality of stages of secondary blade pieces sequentially arranged toward the outer side in the radial direction, and a front edge of the secondary blade piece on a rear stage side of adjacent secondary blade pieces may be positioned on a side in front of a rear edge of the secondary blade piece on a front stage side in the rotation direction.

Accordingly, a border layer which may be present in a flow to be transferred by the secondary blades can be cut off between the secondary blade pieces adjacent to each other. Thus, lift can be more effectively obtained by the entire secondary blades.

The foregoing impeller may further include a cover that covers the plurality of blades in the direction of the axis. When a region between the disk and the cover facing each other in the direction of the axis is divided into a disk side region, a cover side region, and a central region between the disk side region and the cover side region, the secondary blade may not be provided in the central region but may be provided in at least one of the disk side region and the cover side region.

Accordingly, it is possible to obtain a total pressure distribution in which a total pressure in at least one of the disk side and the cover side in a main stream rises.

In the impeller, it is preferable that a chord length of the secondary blade be within a range of 5% to 30% of a chord length of the primary blade.

If the chord length of the secondary blade is excessively long, the pressure surface of the primary blade is hindered from supplying energy to a flow. In addition, if the chord length of the secondary blade is excessively short, the supply amount of energy of the pressure surface of the secondary blade with respect to a flow after the border layer is cut off is reduced.

Energy supplied to a fluid by the primary blade and the secondary blade can be optimized by setting the chord length of the secondary blade within the foregoing range.

In the impeller, it is preferable that when an angle formed by line segments respectively connecting the rear edges of the adjacent primary blades and the axis viewed in the direction of the axis is θ1, and when an angle formed by the line segment connecting the rear edge of the primary blade and the axis and a line segment connecting the front edge of the secondary blade corresponding to the primary blade and the axis viewed in the direction of the axis is θ2, $\theta 2/\theta 1 \leq 0.1$ be established.

Accordingly, as previously stated, energy supplied to a fluid by the primary blade and the secondary blade can be optimized.

According to a second aspect of the present invention, there is provided a rotary machine including any of the impellers described above.

Accordingly, it is possible to realize a rotary machine which can obtain greater lift.

Advantageous Effects of Invention

According to the impeller and the rotary machine of the present invention, greater lift can be obtained.

DESCRIPTION OF EMBODIMENTS

Hereinafter, a compressor (rotary machine) including an impeller according to the present invention will be described with reference to FIGS. 1 to 5.

Figure 1:
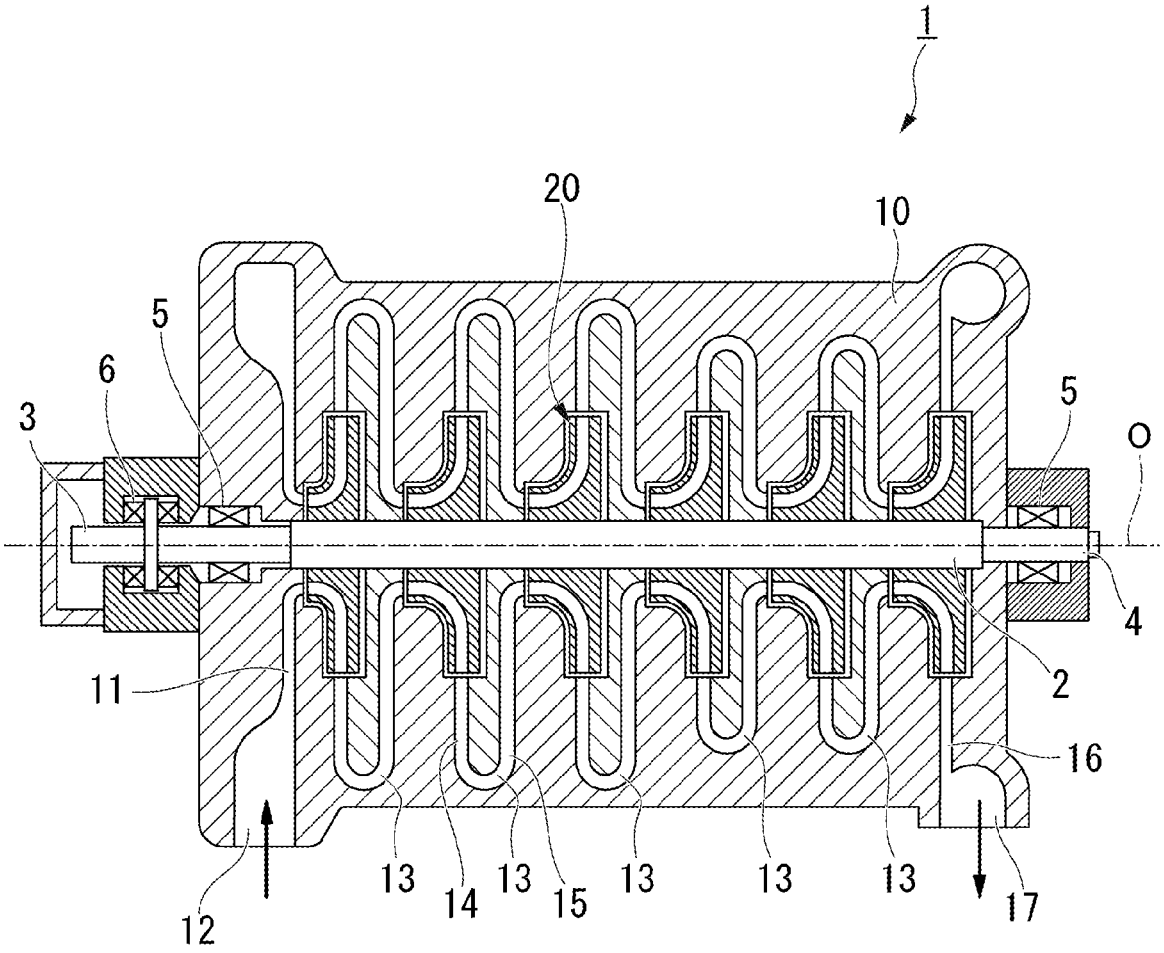
FIG. 1 is a longitudinal cross-sectional view of a rotary machine according to a first embodiment.

As shown in FIG. 1, a compressor 1 includes a rotary shaft 2, journal bearings 5, a thrust bearing 6, impellers 20, and a casing 10. The compressor 1 of the present embodiment is a so-called single-shaft multi-stage compressor including a plurality of stages of the impellers 20.

The rotary shaft 2 has a columnar shape extending in a direction of an axis O laid in the horizontal direction. The rotary shaft 2 is rotatably supported by the journal bearings 5 around the axis O on a first end portion 3 side (one side in the direction of the axis O) and a second end portion 4 side (the other side in the direction of the axis O) in the direction of the axis O. In the rotary shaft 2, the first end portion 3 is supported by the thrust bearing 6.

The impellers 20 are externally fitted to an outer circumferential surface of the rotary shaft 2 and are provided in a plurality of stages at intervals in the direction of the axis O. These impellers 20 rotate around the axis O together with the rotary shaft 2 and perform pressure-feeding of a gas (fluid) flowing in the direction of the axis O toward the outer side in a radial direction. A detailed structure of the impeller 20 will be described below.

The casing 10 is a member formed to have a tubular shape and accommodates the rotary shaft 2, the impellers 20, the journal bearings 5, and the like. The casing 10 rotatably supports the rotary shaft 2 via the journal bearings 5. Accordingly, the impellers 20 attached to the rotary shaft 2 can relatively rotate with respect to the casing 10.

The casing 10 has an introduction channel 11, connection channels 13, and a discharge flow channel 16.

The introduction channel 11 causes a gas to be introduced from the outside of the casing 10 to the impeller 20 in the foremost stage disposed farthest to one side in the plurality of impellers 20 in the direction of the axis O. The introduction channel 11 opens on the outer circumferential surface of the casing 10. The opening serves as an inlet port 12 for a gas. The introduction channel 11 is connected to one side of the impeller 20 in the foremost stage in the direction of the axis O in a part on the inner side in the radial direction.

The connection channel 13 is a flow channel connecting a pair of impellers adjacent to each other in the direction of the axis O. The connection channels 13 cause a gas discharged to the outer side in the radial direction from the impellers 20 on the front stage side to be introduced to the impellers 20 on the rear stage side from one side in the direction of the axis O. The connection channel 13 has a diffuser channel 14 and a return channel 15.

The diffuser channels 14 are connected to the outer side of the impellers 20 in the radial direction. The diffuser channels 14 convert speed energy into pressure energy while causing a gas discharged from the impellers 20 to the outer side in the radial direction to be introduced to the outer side in the radial direction. The return channels 15 are connected to the outer side of the diffuser channels 14 in the radial direction. The return channels 15 cause a gas toward the outer side in the radial direction to turn to the inner side in the radial direction and guide the gas to the impellers 20 on the rear stage side.

The discharge flow channel 16 causes a gas discharged to the outer side in the radial direction from the impeller 20 in the rearmost stage disposed farthest to the other side in the plurality of impellers 20 in the direction of the axis O to be discharged to the outside of the casing 10. The discharge flow channel 16 opens on the outer circumferential surface of the casing 10. The opening serves as a discharge port 17 for a gas. The discharge flow channel 16 is connected to the outer side of the impeller 20 in the rearmost stage in the radial direction in a part on the inner side in the radial direction.

Figure 2:
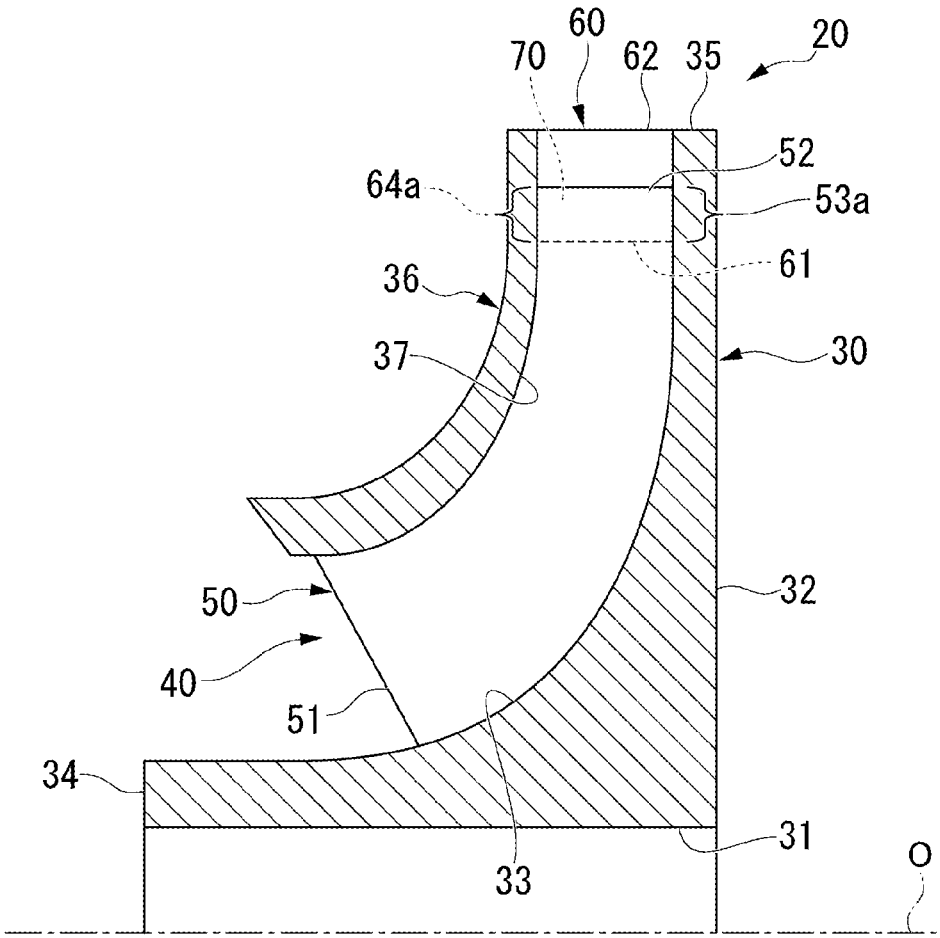
FIG. 2 is a longitudinal cross-sectional view of an impeller according to the first embodiment.
Figure 3:
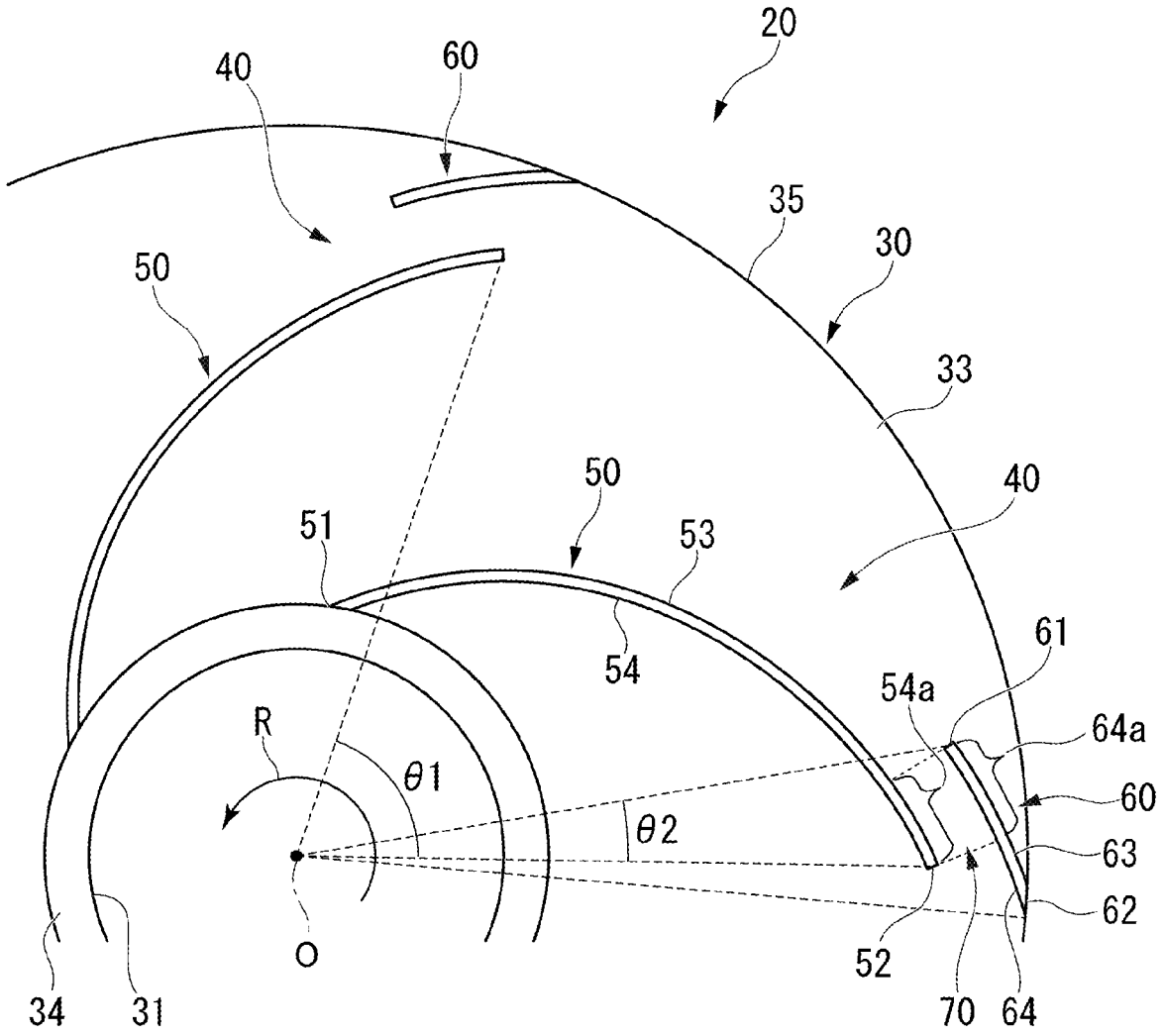
FIG. 3 is a schematic view showing a shape of a blade when the impeller according to the first embodiment is viewed in a direction of an axis.

Next, with reference to FIGS. 2 and 3, a detailed constitution of the impeller 20 will be described. The impeller 20 has a disk 30, blades 40, and a cover 36.

The disk 30 is formed to have a disk shape about the axis O. A through hole 31 having a circular shape about the axis O and penetrating the disk 30 the direction of the axis O is formed in the disk 30. An inner surface of the through hole 31 is fitted to the outer circumferential surface of the rotary shaft 2, so that the impeller 20 is integrally fixed to the rotary shaft 2.

A surface of the disk 30 toward the other side in the direction of the axis O is a disk rear surface 32 having a flat surface shape orthogonal to the axis O. A disk main surface 33, which gradually extends toward the outer side in the radial direction as it goes from one side toward the other side in the direction of the axis, is formed from an end portion of the through hole 31 in the disk 30 on one side in the direction of the axis O to an end portion of the disk rear surface 32 on the outer side in the radial direction. A part of the disk main surface 33 on one side in the direction of the axis O is directed to the outer side in the radial direction. The disk main surface 33 is gradually curved toward one side in the direction of the axis O as it goes toward the other side in the direction of the axis O. That is, the disk main surface 33 is gradually increased in diameter as it goes from one side toward the other side in the direction of the axis O. The disk main surface 33 has a recessed curve surface shape.

In the present embodiment, a disk front end surface 34 having a flat surface shape orthogonal to the direction of the axis O is formed between an end portion of the disk main surface 33 on one side in the direction of the axis O and the end portion of the through hole 31 on one side in the direction of the axis O. A disk outer end surface 35 extending in the direction of the axis O and becoming an outer circumferential edge portion of the disk 30 is provided between the end portion of the disk main surface 33 on the other side in the direction of the axis O and the end portion of the disk rear surface 32 on the outer side in the radial direction.

A plurality of blades 40 are provided at intervals in a circumferential direction of the axis O on the disk main surface 33 in the disk 30. Each of the blades 40 is curved toward the rear side in a rotation direction R (one side in the circumferential direction) of the impellers 20 as it goes from the inner side in the radial direction toward the outer side in the radial direction. Each of the blades 40 extends while having a projected curve surface projected toward the front side in the rotation direction R.

The cover 36 covers the plurality of blades 40 from one side in the direction of the axis O. The cover 36 is provided to face the disk 30 such that the blades 40 are interposed between the cover 36 and the disk 30. An inner circumferential surface 37 of the cover 36 is formed to be gradually increased in diameter as it goes from one side toward the other side in the direction of the axis O. The inner circumferential surface 37 of the cover 36 is curved in a manner similar to that of the disk main surface 33 to correspond to the disk main surface 33. End portions of the blades 40 on a side opposite to the disk main surface 33 side are fixed to the inner circumferential surface 37 of the cover 36.

A flow channel extending to curve to the rear side in the rotation direction R as it goes from one side toward the other side in the direction of the axis O is formed between and by the inner circumferential surface 37 of the cover 36, the disk main surface 33, and the blades 40.

Here, in the present embodiment, each of the blades 40 is constituted of primary blades 50 and secondary blades 60 respectively corresponding to the primary blades 50.

The primary blade 50 has a blade shape extending to the rear side in the rotation direction R as it goes from the inner side toward the outer side in the radial direction. A front edge 51 of the primary blades 50 are disposed at positions close to an end portion of the cover 36 on one side in the direction of the axis O. Rear edges 52 of the primary blades 50 are positioned on the inner side of the outer circumferential edge portion of the disk 30 in the radial direction. That is, the rear edges 52 of the primary blades 50 do not lead to the outer circumferential edge portion of the disk 30 and are disposed at intervals with respect to the outer circumferential end portion on the inner side of the outer circumferential edge portion in the radial direction.

A surface of the primary blade 50 toward the front side in the rotation direction R (the other side in the circumferential direction) serves as a pressure surface 53, and a surface toward the rear side in the rotation direction R serves as a suction surface 54.

The secondary blades 60 are provided at intervals on a rear edge side of the corresponding primary blades 50 and the front side in the rotation direction R. The secondary blade 60 has a blade shape extending to the rear side in the rotation direction R as it goes from the inner side toward the outer side in the radial direction. A front edge 61 of the secondary blade 60 is positioned on the outer side of the front edge 51 of the primary blade 50 in the radial direction. A rear edge 62 of the secondary blade 60 leads to the outer circumferential edge portion of the disk 30.

A surface of the secondary blade 60 toward the front side in the rotation direction R (the other side in the circumferential direction) serves as a pressure surface 63. A surface toward the rear side in the rotation direction R serves as a suction surface 64.

The secondary blade 60 is positioned on a curved line realized by smoothly extending an imaginary curved line of the primary blade 50 from the rear edge 62 to the outer circumferential edge portion while being shifted as it stands to a side to which the pressure surface 53 of the primary blade 50 is directed. The front edge 61 of the secondary blade 60 is disposed on the upstream side of a flow of a gas along the pressure surface 53 of the primary blade 50 from the rear edge 52 of the primary blade 50 and at a position separated from the primary blade 50 in a direction in which the pressure surface 53 of the primary blade 50 is directed.

Here, a rear edge side region 53*a* which is a part including the rear edge 52 on the pressure surface 53 in the primary blade 50, and a front edge side region 64*a* which is a part including the front edge 61 on the suction surface 64 in the secondary blade 60 face each other. Accordingly, the rear edge side region 53*a* of the primary blade 50 and the front edge side region 64*a* of the secondary blade 60 overlap each other in a direction orthogonal to a flowing direction of a gas along the pressure surface 53 of the primary blade 50. In other words, parts of the primary blade 50 and the secondary blade 60 overlapping each other in a direction orthogonal to the flowing direction of a gas serve as the rear edge side region 53*a* of the primary blade 50 and the front edge side region 64*a* of the secondary blade 60. In this manner, due to the rear edge side region 53*a* of the primary blade 50 and the front edge side region 64*a* of the secondary blade 60 facing each other, a peeling cutting flow channel 70 for cutting off peeling from a gas flowing between the primary blades 50 is formed between the rear edge side region 53*a* and the front edge side region 64*a*. The peeling cutting flow channel 70 may be increased or decreased as the width viewed in the direction of the axis O goes toward the downstream side.

The chord length of the secondary blade 60 (length of a line segment connecting the front edge 61 and the rear edge 62 of the secondary blade 60 when viewed in the direction of the axis O) is preferably set to the length within a range of 5% to 30% and is more preferably set to the length within a range of 5% to 20% of the chord length of the primary blade 50 (length of a line segment connecting the front edge 51 and the rear edge 52 of the primary blade 50 when viewed in the direction of the axis O).

Here, an angle formed by line segments respectively connecting the rear edges 52 of the adjacent primary blades 50 and the axis O viewed in the direction of the axis O is referred to as θ1. In addition, an angle formed by the line segment connecting the rear edge 52 of the primary blade 40 and the axis O and a line segment connecting the front edge 61 of the secondary blade 60 corresponding to the primary blade 50 and the axis O viewed in the direction of the axis O is referred to as θ2. At this time, in the present embodiment, it is preferable that θ2/θ1≤0.1 be established.

In other words, the angle θ1 is an angle formed by a straight line passing through the axis O and the rear edge 52 of the primary blade 50 on the front side in the rotation direction R of the primary blades 50 adjacent to each other, and a straight line passing through the axis O and the rear edge 52 of the primary blade 50 on the rear side in the rotation direction R of the primary blades 50 adjacent to each other. On the other hand, the angle θ2 is an angle formed by a straight line passing through the axis O and the front edge 61 of the secondary blade 60, and a straight line passing through the axis O and the rear edge 2 of the secondary blade 60.

It is preferable that the rear edge 52 of the corresponding primary blade 50 be positioned within the range of the angle θ2 of the secondary blade 60 corresponding to the primary blade 50.

It is preferable that the secondary blade 60 corresponding to the primary blade 50 be disposed closer to the corresponding primary blade 50 than the primary blade 50 positioned on a side in front of the primary blade 50 in the rotation direction R.

The foregoing impellers 20 may be produced using a 3D printer, for example.

Next, operational effects of the impellers 20 and the compressor 1 of the present embodiment will be described.

When the impellers 20 rotates in accordance with rotation of the rotary shaft 2, a gas is introduced to the flow channels inside the impellers 20 from one side in the direction of the axis O. In this manner, during a process toward the outer side in the radial direction inside the flow channel, energy from the pressure surfaces 53 of the primary blades 50 is applied to a gas which has been introduced into the impellers 20, and the gas is boosted.

Figure 4:
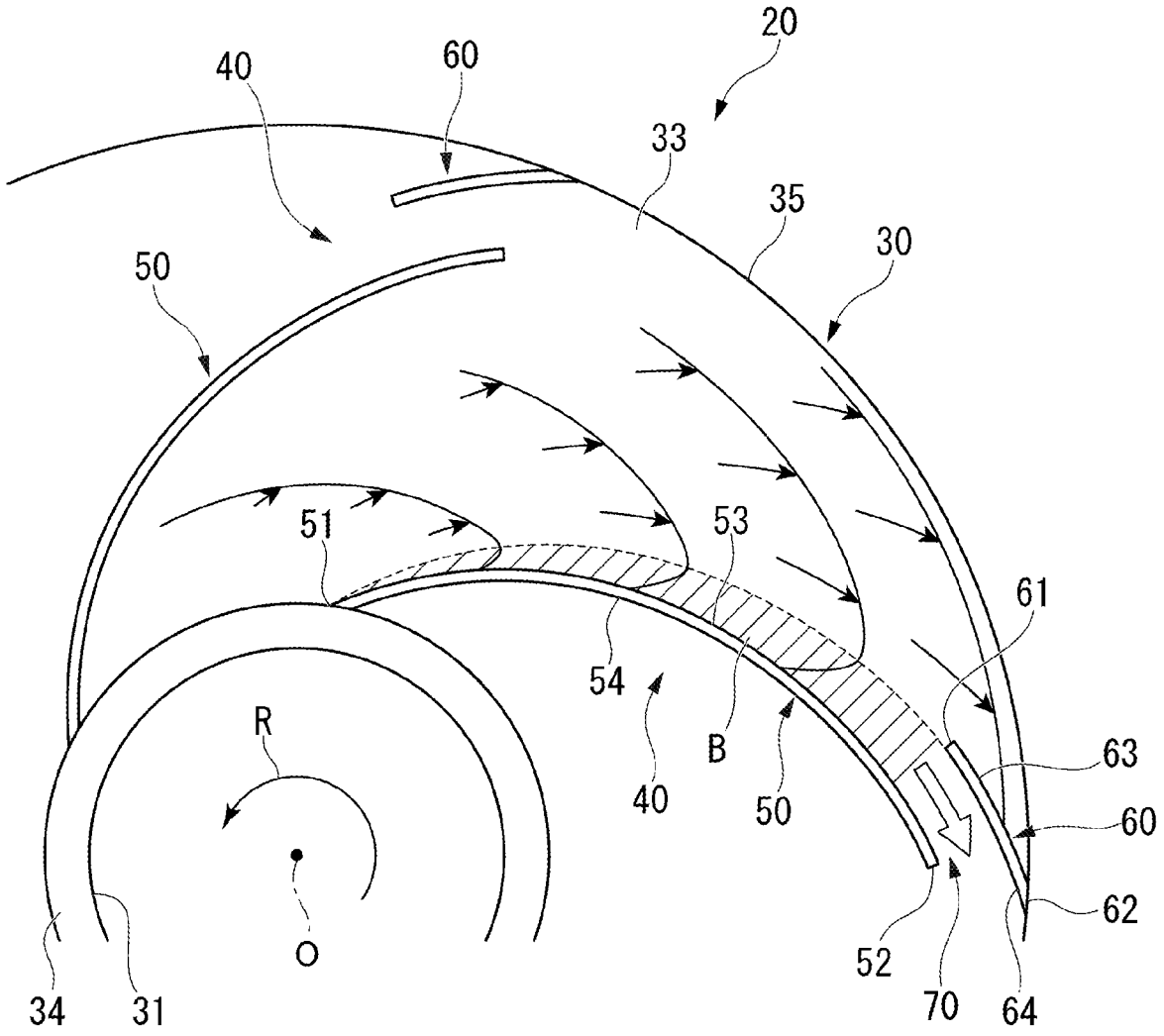
FIG. 4 is a schematic view showing the shape of the blade when the impeller according to the first embodiment is viewed in the direction of the axis, and the diagram shows an action of the impeller.

Here, inside the flow channels of the impellers 20, as shown in FIG. 4, as it goes toward the downstream side (outer side in the radial direction), border layers B grow on the pressure surfaces 53 of the primary blades 50 due to the influence of the viscosity of the pressure surfaces 53 of the primary blades 50. In the present embodiment, the border layers B which have grown in this manner move forward along the pressure surfaces 53 of the primary blades 50 inside the peeling cutting flow channels 70 formed between the pressure surfaces 53 and the suction surfaces 64 of the secondary blades 60. That is, the border layers B are cut off in regions between the rear edges 52 of the primary blades 50 and the front edges 61 of the secondary blades 60.

On the other hand, the pressure surfaces 63 of the secondary blades 60 apply energy to flows which are less affected by the border layers B and are separated from the pressure surface 53 of the primary blade 50 to the front side in the rotation direction R or flows which are not affected by the border layers B, and the flows are boosted.

In this manner, in the present embodiment, the border layers B in flows between the primary blades 50 and the secondary blades 60 are temporarily reset. If the border layers B are not reset, peeling may occur by being further boosted thereafter. In the present embodiment, the border layers B which have grown in the primary blades 50 are cut off in the middle of the process, so that a gas can be further boosted thereafter by the secondary blades 60. That is, since lift can be effectively obtained by the secondary blades 60 without causing peeling, greater lift can be obtained in the impellers 20 overall.

The cut border layers B merge with flows near the suction surfaces 54 of the primary blades 50. Accordingly, energy can be supplied to places near the suction surfaces 54, and therefore it is possible to obtain an effect of preventing peeling near the suction surface 54.

In addition, if the rear edges 52 of the primary blades 50 have led to the outer circumferential edge portion of the disk 30, there is a possibility that the border layers B may peel off due to the primary blades 50. However, since the primary blades 50 do not lead to the outer circumferential end portion, no peeling occurs.

In addition, in the present embodiment, the rear edge side region 53*a* on the pressure surface 53 of the primary blade 50 and the front edge side region 64*a* on the suction surface 64 of the secondary blade 60 overlap each other in a direction orthogonal to a flow of a fluid, and the peeling cutting flow channel 70 is formed therebetween. Therefore, the border layers B which have grown on the pressure surfaces 53 of the primary blades 50 are caused to be cut off by the front edges 61 of the secondary blades 60 and are transferred to the outer side in the radial direction as they stand along the pressure surfaces 53 of the primary blades 50. Therefore, the border layers B can be more reliably cut off by flows between the primary blades 50.

Moreover, since the secondary blade 60 is disposed close to the corresponding primary blade 50 side of a pair of primary blades 50 adjacent to each other, the border layer B which has grown on the pressure surface 53 of the corresponding primary blade 50 can be more reliably cut off by the secondary blade 60. It is preferable that the separation distance from the corresponding primary blade 50 to the front edge 61 of the secondary blade 60 be equivalent to or larger than the thickness of the border layer B which has developed on the pressure surface 53 of the primary blade 50 at a position of the front edge 61 of the secondary blade 60.

Here, if the chord length of the secondary blade 60 is excessively long, the pressure surfaces 53 of the primary blades 50 are hindered from supplying energy to flows. In addition, if the chord length of the secondary blade 60 is excessively short, the supply amount of energy of the pressure surface 63 of the secondary blade 60 with respect to a flow after the border layer B is cut off is reduced.

In the present embodiment, since the chord length of the secondary blade 60 is set to a range of 5% to 30% of the chord length of the primary blade 50, energy supplied to a gas by the primary blades 50 and the secondary blades 60 can be optimized.

In addition, since a relationship of θ2/θ1≤0.1 is established between the angle θ1 and the angle θ2, as previously stated, operational effects of the primary blades 50 and the secondary blades 60 can be further enhanced.

Figure 5:
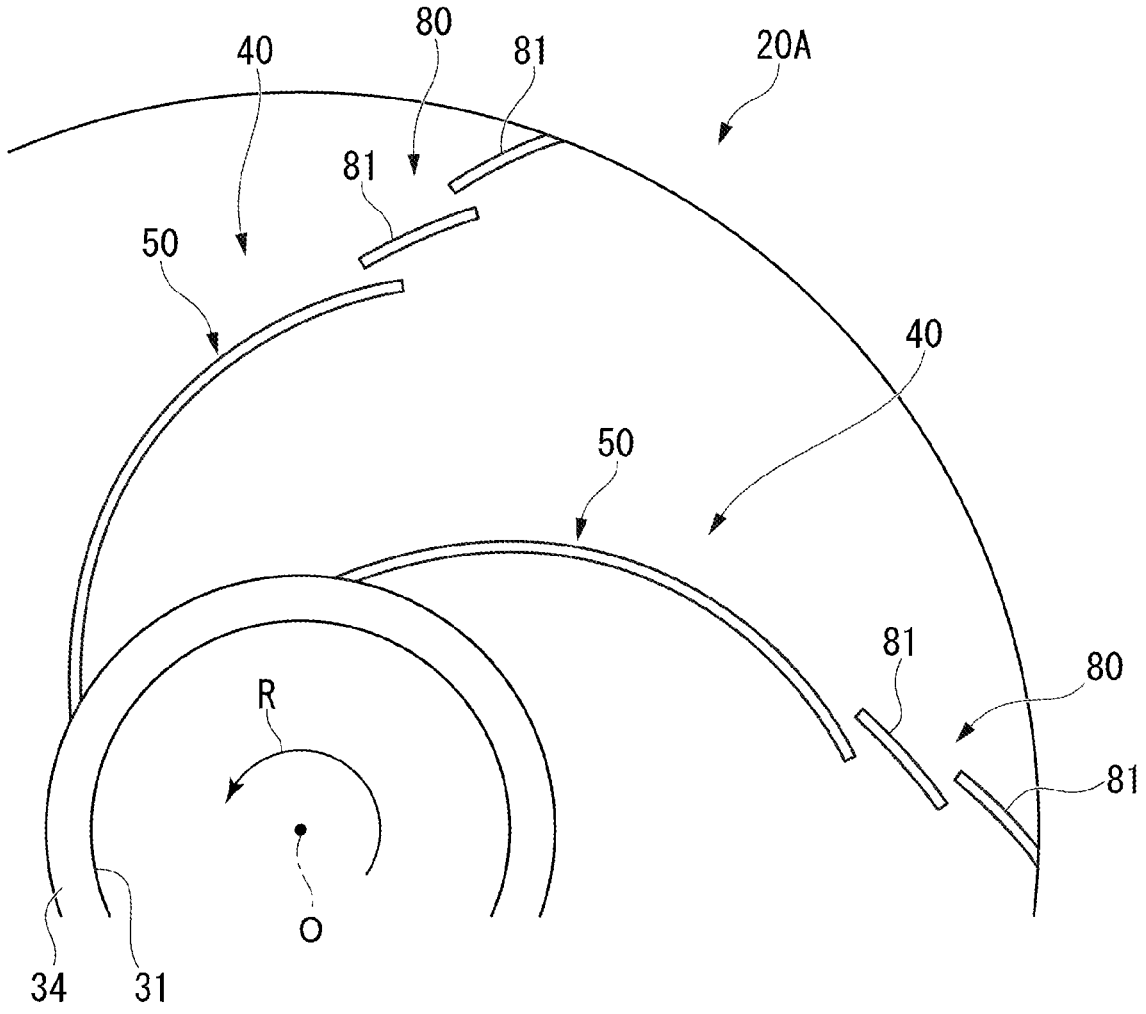
FIG. 5 is a schematic view showing a shape of a blade when an impeller according to a second embodiment is viewed in the direction of the axis.

Next, a second embodiment of the present invention will be described with reference to FIG. 5. In the second embodiment, the same reference signs are applied to the same constituent elements as the first embodiment, and a detailed description thereof will be omitted.

An impeller 20A of the second embodiment differs from the first embodiment in constitution of secondary blades 80. The secondary blade 80 of the second embodiment is constituted of a plurality of stages of secondary blade pieces 81.

The plurality of stages of secondary blade pieces 81 are sequentially arranged at intervals toward the outer side in the radial direction. In the present embodiment, the secondary blade 80 is constituted of the secondary blade pieces 81 in two stages. Each of the secondary blade pieces 81 has a blade shape extending to the rear side in the rotation direction R as it goes toward the outer side in the radial direction. In each of the secondary blade pieces 81, a surface toward the front side in the rotation direction R serves as a pressure surface, and a surface toward the rear side in the rotation direction R serves as a suction surface.

The front edge of the secondary blade piece 81 in the front stage (front edge of the secondary blade 80) is disposed on the upstream side of a flow of a gas along the pressure surface 53 of the primary blade 50 from the rear edge 52 of the primary blade 50 to be separated in a direction in which the pressure surface 53 of the primary blade 50 is directed. The rear edge of the secondary blade piece 81 in the front stage is separated from the outer circumferential edge portion of the disk 30 to the inner side in the radial direction.

The front edge of the secondary blade piece 81 in the rear stage is disposed on the upstream side of a flow of a gas along the pressure surface of the secondary blade piece 81 in the front stage from the rear edge of the secondary blade piece 81 in the front stage to be separated in a direction in which the pressure surface of the secondary blade piece 81 in the front stage is directed. The rear edge of the secondary blade piece 81 in the rear stage leads to the outer circumferential edge portion of the disk 30.

According to the impellers 20A of the second embodiment, the border layers B which have grown on the pressure surfaces 53 of the primary blades 50 are cut off between the secondary blade pieces 81 in the front stages. In addition, the border layers B which have grown on the pressure surfaces of the secondary blade pieces 81 in the front stages are cut off between the secondary blade pieces 81 in the rear stages. Therefore, since the border layers B can be sequentially reset as they go toward the downstream side, lift can be more effectively obtained by the entire secondary blades 80.

The second embodiment may have three or more secondary blade pieces 81. In this case, the relationship between secondary blade pieces 81 adjacent to each other is similar to the relationship between the secondary blade piece 81 in the front stage and the secondary blade piece 81 in the rear stage. In addition, the rear edge of the secondary blade piece 81 in the rearmost stage is positioned in the outer circumferential edge portion of the disk 30.

Figure 6:
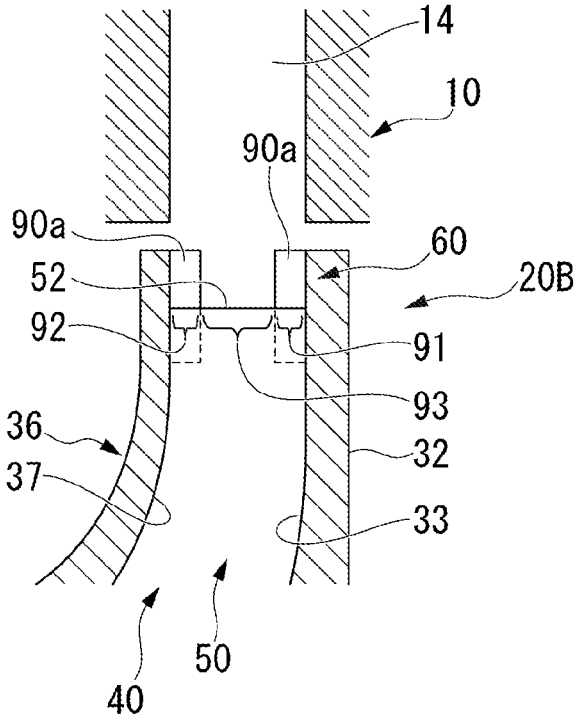
FIG. 6 is a longitudinal cross-sectional view of an impeller according to a third embodiment.

Next, a third embodiment of the present invention will be described with reference to FIG. 6. In the third embodiment, the same reference signs are applied to the same constituent elements as the first embodiment, and detailed description thereof will be omitted.

In an impeller 20B of the third embodiment, a pair of secondary blades 90*a* and 90*b* are provided to correspond to the primary blade 50 while being separated from each other on the disk 30 side and the cover 36 side.

That is, in a cross-sectional view including the axis O, when the flow channel is divided into three regions including a disk side region 91, a cover side region 92, and a central region 93, the secondary blades 90*a* and 90*b* are provided in only the disk side region 91 and the cover side region 92 and are not provided in the central region 93.

Accordingly, a total pressure distribution in which the total pressure near the wall surface in the direction of the axis O rises is realized inside the diffuser channels 14. Therefore, peeling in the diffuser channels 14 is curbed, and significant pressure recovery in the diffuser channels 14 can be expected. As a result, the compressor 1 in its entirety can have a compact size, and the number of stages can be reduced.

In the third embodiment, for example, a secondary blade may be provided in only the disk side region 91, or the secondary blades 90*a* and 90*b* may be provided in only the cover side region 92. Accordingly, as previously stated, peeling at any place in the diffuser channels 14 in the direction of the axis O can be curbed.

Hereinabove, embodiments of the present invention have been described. However, the present invention is not limited thereto and can be suitably changed within a range not departing from the technical idea of the invention.

In the embodiments, each of the impellers 20, 20A, and 20B has been described as a closed impeller including the cover 36. However, the present invention may be applied to an open impeller which does not include the cover 30.

In the embodiments, the compressor 1 has been described as an example of a rotary machine. However, for example, the present invention may also be applied to other rotary machines such as pumps.

INDUSTRIAL APPLICABILITY

According to an impeller and a rotary machine of the present invention, greater lift can be obtained.

REFERENCE SIGNS LIST

1 Compressor
2 Rotary shaft
3 First end portion
4 Second end portion
5 Journal bearing
6 Thrust bearing
10 Casing
11 Introduction channel
12 Inlet port
13 Connection channel
14 Diffuser channel
15 Return channel
16 Discharge flow channel
17 Discharge port
20 Impeller
30 Disk
31 Through hole
32 Disk rear surface
33 Disk main surface
34 Disk front end surface
35 Disk outer end surface
36 Cover
37 Inner circumferential surface
40 Blade
50 Primary blade
51 Front edge
52 Rear edge
53 Pressure surface
53*a* Rear edge side region
54 Suction surface
60 Secondary blade
61 Front edge
62 Rear edge
63 Pressure surface
64 Suction surface
64*a* Front edge side region
70 Peeling cutting flow channel
80 Secondary blade
81 Secondary blade pieces
90*a* Secondary blade
90*b* Secondary blade
91 Disk side region
92 Cover side region
93 Central region B Border layer
O Axis
R Rotation direction

What is claimed is:

1. An impeller comprising:

a disk that has a disk shape and is configured to rotate around an axis;

a plurality of blades that are provided at intervals in a circumferential direction on a side of a surface of the disk toward a direction of the axis and extend to a rear side in a rotation direction as the plurality of the blades go toward an outer side in a radial direction; and a cover that covers the plurality of blades in the direction of the axis, wherein each of the plurality of the blades has:

a primary blade which extends to the rear side in the rotation direction as the primary blade goes from an inner side toward the outer side in the radial direction and of which a rear edge is positioned on the inner side with respect to an outer circumferential edge portion of the disk in the radial direction, and a secondary blade which is provided at intervals on a side in front of the primary blade in the rotation direction to correspond to the primary blade, of which a front edge is positioned on the outer side with respect to a front edge of the primary blade in the radial direction, and of which a rear edge is positioned on the outer circumferential edge portion of the disk, a region between the disk and the cover facing each other in the direction of the axis is divided into a disk side region, a cover side region, and a central region between the disk side region and the cover side region, and the secondary blade is not provided in the central region but is provided in at least one of the disk side region and the cover side region.

2. The impeller according to claim 1, wherein a rear edge side region on a pressure surface of the primary blade and a front edge side region on a suction surface of the secondary blade corresponding to the primary blade face each other.

3. The impeller according to claim 2, wherein the secondary blade has a plurality of stages of secondary blade pieces sequentially arranged toward the outer side in the radial direction, and a front edge of the secondary blade piece on a rear stage side of adjacent secondary blade pieces is positioned on a side in front of a rear edge of the secondary blade piece on a front stage side in the rotation direction.

4. The impeller according to claim 1, wherein the secondary blade is disposed close to the corresponding primary blade of a pair of primary blades adjacent to each other.

5. The impeller according to claim 4, wherein the secondary blade has a plurality of stages of secondary blade pieces sequentially arranged toward the outer side in the radial direction, and a front edge of the secondary blade piece on a rear stage side of adjacent secondary blade pieces is positioned on a side in front of a rear edge of the secondary blade piece on a front stage side in the rotation direction.

6. The impeller according to claim 1, wherein the secondary blade has a plurality of stages of secondary blade pieces sequentially arranged toward the outer side in the radial direction, and a front edge of the secondary blade piece on a rear stage side of adjacent secondary blade pieces is positioned on a side in front of a rear edge of the secondary blade piece on a front stage side in the rotation direction.

7. The impeller according to claim 1, wherein a chord length of the secondary blade is within a range of 5% to 30% of a chord length of the primary blade.

8. A rotary machine comprising:

the impeller according to claim 1.

9. The impeller according to claim 1, wherein the secondary blade is not provided in the central region but is provided in the disk side region and the cover side region.

10. The impeller according to claim 1, wherein the cover forms a flow channel of the impeller along with the surface of the disk on which the plurality of blades are provided.

11. An impeller comprising:

a disk that has a disk shape and is configured to rotate around an axis;

a plurality of blades that are provided at intervals in a circumferential direction on a side of a surface of the disk toward a direction of the axis and extend to a rear side in a rotation direction as the plurality of the blades go toward an outer side in a radial direction, wherein each of the plurality of the blades has:

a primary blade which extends to the rear side in the rotation direction as the primary blade goes from an inner side toward the outer side in the radial direction and of which a rear edge is positioned on the inner side with respect to an outer circumferential edge portion of the disk in the radial direction, and a secondary blade which is provided at intervals on a side in front of the primary blade in the rotation direction to correspond to the primary blade, of which a front edge is positioned on the outer side with respect to a front edge of the primary blade in the radial direction, and of which a rear edge is positioned on the outer circumferential edge portion of the disk, and when an angle formed by line segments respectively connecting the rear edges of the adjacent primary blades and the axis viewed in the direction of the axis is $\theta 1$, and when an angle formed by the line segment connecting the rear edge of the primary blade and the axis and a line segment connecting the front edge of the secondary blade corresponding to the primary blade and the axis viewed in the direction of the axis is $\theta 2$, $\theta 2/\theta 1 \leq 0.1$ is established.

* * * * *